US005203041A

United States Patent [19]

Alonso

[11] Patent Number: 5,203,041

[45] Date of Patent: Apr. 20, 1993

[54] CHILD'S REST MAT

[76] Inventor: Frank Alonso, 29458 Blue Water, Malibu, Calif. 90265

[21] Appl. No.: 871,555

[22] Filed: Apr. 20, 1992

[51] Int. Cl.[5] ..... A47G 9/06; A47C 27/14

[52] U.S. Cl. ..... 5/420; 5/470; 5/466; 190/2; 383/15

[58] Field of Search ..... 5/420, 417, 418, 470, 5/419, 490, 501, 466; 190/1, 2; 383/15

[56] References Cited

U.S. PATENT DOCUMENTS

| | | | |
|---|---|---|---|
| 1,349,258 | 8/1920 | Blocksom | 5/490 |
| 3,879,775 | 4/1975 | Iwata | 5/420 |
| 4,188,988 | 2/1980 | Agyagos | 5/417 |
| 4,592,091 | 5/1986 | Italici | 383/15 |
| 4,843,662 | 7/1989 | Handelman | 5/420 |
| 5,010,610 | 4/1991 | Ackley | 5/420 |
| 5,035,013 | 7/1991 | Bloom | 5/420 |
| 5,048,975 | 9/1991 | Holbrook | 5/420 |
| 5,099,530 | 3/1992 | Scott | 5/420 |

FOREIGN PATENT DOCUMENTS

| | | | |
|---|---|---|---|
| 148769 | 2/1904 | Fed. Rep. of Germany | 5/490 |
| 1264919 | 2/1972 | United Kingdom | 5/417 |

*Primary Examiner*—Alexander Grosz
*Attorney, Agent, or Firm*—Louis J. Bachand

[57] ABSTRACT

A child's rest mat comprising a fabric covered foam pad having longitudinally spaced fold lines, and handles at opposed fold lines in the folded condition of the mat, the handles having interlocking tabs to maintain the mat folded for carrying.

10 Claims, 1 Drawing Sheet

FIG. 1
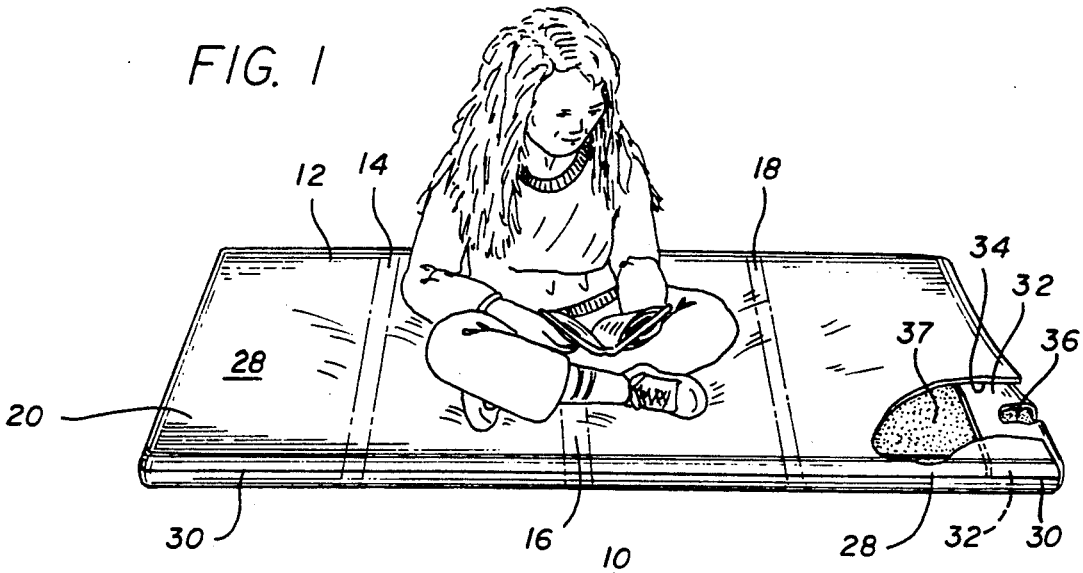
FIG. 2
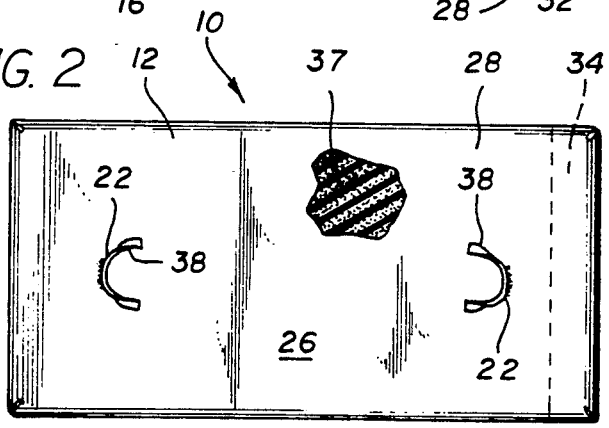
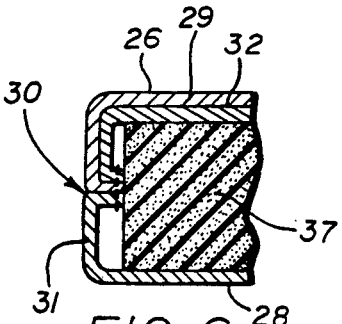
FIG. 6
FIG. 3
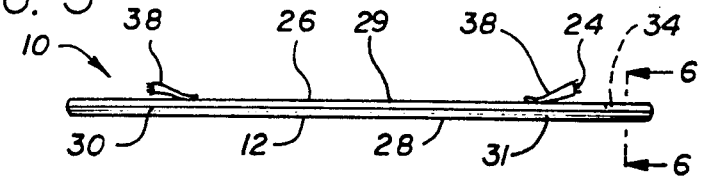
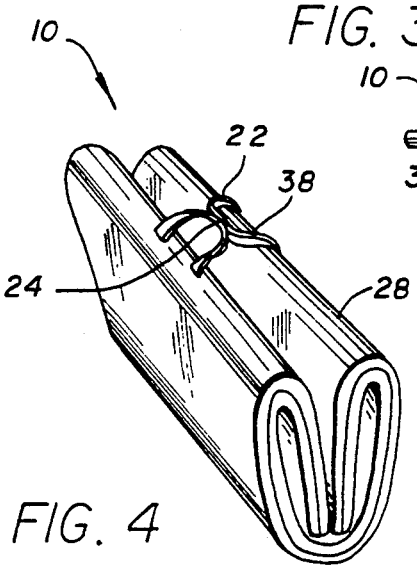
FIG. 4
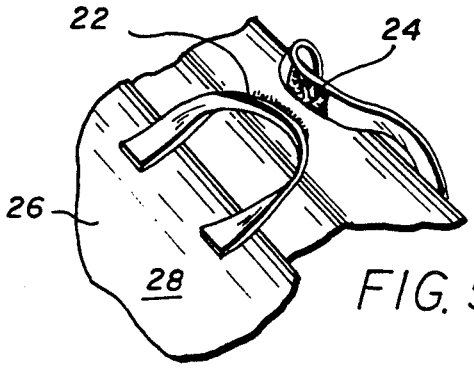
FIG. 5

CHILD'S REST MAT

TECHNICAL FIELD

This invention relates to child's rest mats, and more particularly to a child's rest mat which is lightweight, comfortably covered with breathable fabric, washable, easily ported and stored and, more broadly, an improvement over known child's rest mats.

BACKGROUND

The growth of childcare facilities, nursery schools, preschools, and increased numbers of students in kindergartens and primary grades has highlighted the need for rest mats for the children to use during rest times and more active learning periods such as reading time.

SUMMARY OF THE INVENTION

It is accordingly an object of the present invention to provide a rest mat for children. It is another object to provide a child's rest mat in which the covering is a woven fabric for comfort, a removable for washing. It is a further object to provide a child's rest mat which is foldable into a compact form for ease of carrying and storage. It is yet another object to provide a child's rest mat having means to secure the mat in the folded condition and handles to carry the folded mat. It is also an object to provide a child's rest mat in which the securing means are carried by the handles on the under side of the mat to be out of the way when the mat is being used for resting, and conveniently juxtaposed when the mat is to be secured folded.

These and other objects of the invention to become apparent hereinafter are realized in a child's rest mat comprising a suitably sized, generally planar foam pad capable of folding on itself along longitudinally spaced fold lines, a fabric cover enclosing the pad, and means securing the covered pad for carrying, the securing means comprising a pair of longitudinally spaced interlocking tabs fastened to one face of the pad cover at opposed ones of the fold lines for maintaining the covered pad in folded condition.

In this and like embodiments, typically, the pad cover comprises a woven fabric sewn along its edges to the dimensions of the pad, a portion of the fabric being returned at one end to define an interior pocket for receiving an end of the pad to maintain the pad within the fabric cover in a predetermined orientation; the pad is a resilient polyurethane foam; the tabs carry cooperating hooked fibers for interlocking the tabs; and, the mat has three approximately evenly longitudinally spaced fold lines to fold twice on itself in its folded condition, the securing means being fastened to the outer two of the fold lines.

In a particularly preferred mode, there is also included handles secured to the pad cover midway between the pad cover ends and side edges, the interlocking tabs being carried on the handles in opposed relation in the folded condition of the mat; the pad cover comprises a woven fabric sewn along its edges to the dimensions of the pad, a portion of the fabric being returned at one end to define an interior pocket for receiving an end of the pad to maintain the pad within the fabric cover in a predetermined orientation such that the tabs are maintained opposed in the folded condition of the mat; the pad is a resilient polyurethane foam; the tabs carry cooperating hooked fibers for interlocking the tabs; the mat is adapted to first fold endwise onto itself, and the folded portions then fold on themselves, the handles being located centrally between the sides of the mat, and respectively at the locus of the of the first folds; the are handles secured to the pad cover in interlocking tab supporting relation, the tabs being carried on the handles in opposed relation in the folded condition of the mat; and, the handles secured together by the tabs define a carrying means for the mat.

THE DRAWINGS

The invention will be further described in conjunction with the attached drawings in which:

FIG. 1 is a perspective view of the child's rest mat of the invention;

FIG. 2 is a bottom plan view thereof:

FIG. 3 is a side elevation view thereof;

FIG. 4 is an isometric view of the mat in folded condition;

FIG. 5 is a fragmentary detail view of the invention mat showing the handle and fastener: and, FIG. 6 is a view taken on line 6—6 in FIG. 3.

DETAILED DESCRIPTION

With reference to the drawing in detail, in FIGS. 1–4, the invention child's rest mat is shown at 10 and comprises a suitably sized, e.g. 18–24" by 36–48" generally planar foam pad 12 capable of folding on itself along longitudinally spaced fold lines 14, 16 and 18, a fabric pad cover 20 enclosing the pad, and means 22 securing the covered pad for carrying, comprising a pair of longitudinally spaced interlocking tabs 24 fastened to the underside face 26 of the pad cover at opposed ones 14, 18 of the fold lines for maintaining said covered pad in folded condition.

It will be noted that the pad cover 20 comprises a woven fabric 28 in upper and lowers layers 29, 31 sewn at their perimeter edge 30 to the dimensions of said pad, a portion 32 of the fabric 28 is returned at one end and its longitudinal edges sewn to the upper and lower layers 29, 31 as shown in FIG. 6 to define an interior pocket 34 for receiving end 36 of the pad, thus to maintain the pad within the fabric cover in a predetermined orientation.

Typically, and preferably, the pad 12 is formed of a resilient polyurethane or other synthetic organic resin foam 37. Other materials affording a comfort to the user through thickness or foam can be used as well.

As will be noted in FIGS. 2–5, the mat 10 is foldable twice upon itself. While the fold lines are not preformed or scored into the mat 10, the mat will fold along the three fold lines 14, 16 and 18 by simply folding the mat upon itself in half and then folding each half again, See FIG. 4. The fold lines 14, 16 and 18 are thus approximately evenly longitudinally spaced so that the mat will be folded twice on itself in its folded condition. The mat 10 is maintained in its folded condition by the use of the interlocking tabs 24. The tabs 24 are carried on a pair of handles 38, being strips of suitably durable woven or braided fabric sewn at their ends to the fabric cover 20. The dimensions of handles 38 are not critical provided their length affords a loop with the cover 20 that admits of a hand being inserted and their width is comfortable for carrying the rest mat. The handles 38 are placed on the cover 20 at the locus of the outboard fold lines 14, 18 so as to support the interlocking tabs 24 midway between the pad cover ends and side edges. The tabs 24 are affixed to the handles 38 by sewing or gluing arranged so as to be in opposed relation in the folded condition of said mat, thus to be readily connected. The specific form of the interlocking tabs 24 is not critical with snaps, fasteners, buttons and button, holes being suitable, but most preferred is a hook and loop type fastener such as the one sold under the trademark VELCO, comprising cooperating hooked fibers for interlocking the tabs 24 and thus the handles 38.

In use the rest mat is taken out at pre-school or other situation, unfolded, and the child lies or sits upon it during rest periods or for active listening. Afterwards, the mat is readily refolded even by small children.

The foregoing objects are thus achieved.

I claim;

1. A child's rest may comprising a suitably sized, generally planar foam pad capable of folding on itself along longitudinally spaced fold lines, a removable fabric cover sewn along its edges to the dimensions of the pad and enclosing said pad, said cover having at one end a return portion sewn in said cover at said fabric edges to define an interior pocket for said pad, and means securing the covered pad for carrying, said securing means comprising a pair of longitudinally spaced interlocking tabs fastened to one face of said pad cover at opposed ones of said fold lines for maintaining said covered pad in folded condition.

2. Child's rest mat according to claim 1, in which said pad is a resilient polyerethane foam.

3. Child's rest mat according to claim 1, in which said tabs carry cooperating hooked fibers for interlocking said tabs.

4. Child's rest mat according to claim 1, in which said mat has three approximately evenly longitudinally spaced fold lines to fold twice on itself in its folded condition, said securing means being fastened to said pad cover face at the outer two of said fold lines.

5. Child's rest mat according to claim 1, including also handles secured to said pad cover midway between the pad cover ends and side edges, said interlocking tabs being carried on said handles in opposed relation in the folded condition of said mat.

6. Child's rest mat comprising a suitably sized, generally planar foam mat capable of folding on itself along longitudinally spaced fold lines, a removable fabric cover enclosing said pad, means securing the covered pad for carrying, said securing means comprising a pair of longitudinally spaced interlocking tabs fastened to one face of said pad cover at opposed ones of said fold lines for maintaining said covered pad in folded condition, handles secured to said pad cover midway between the pad cover ends and side edges, said interlocking tabs being carried on said handles in opposed relation in the folded condition of said mat, said pad cover comprising a woven fabric sewn along its edges to the dimensions of said pad, a portion of said fabric being returned at one end to define an interior pocket for receiving an end of said pad to maintain said pad within said fabric cover in a predetermined orientation such that said tabs are maintained opposed in the folded condition of said mat.

7. Child's rest mat according to claim 6, in which said pad is a resilient polyerethane foam.

8. Child's rest mat according to claim 7, in which said tabs carry cooperating hooked fibers for interlocking said tabs.

9. Child's rest mat according to claim 8, in which said mat is adapted to first fold endwise onto itself, and said folded portions then fold on themselves, said handles being located centrally between the sides of said mat, and respectively at the locus of said of said first folds.

10. Child's rest mat according to claim 6, in which said handles secured together by said tabs define a carrying means for said mat.

* * * * *